US005875611A

United States Patent [19]

Plourde

[11] Patent Number: 5,875,611

[45] Date of Patent: Mar. 2, 1999

[54] OFFSET SEALING METHOD FOR PLASTIC FILMS

[75] Inventor: Eric P. Plourde, Tinley Park, Ill.

[73] Assignee: Illinois Tool Works Inc., Glenview, Ill.

[21] Appl. No.: 131,298

[22] Filed: Aug. 10, 1998

Related U.S. Application Data

[62] Division of Ser. No. 804,627, Feb. 25, 1997.

[51] Int. Cl.[6] ..... B65B 61/18

[52] U.S. Cl. ..... 53/412; 493/213; 493/214

[58] Field of Search ..... 53/412, 133.4, 53/139.2; 493/213, 214, 927

[56] References Cited

U.S. PATENT DOCUMENTS

| | | | |
|---|---|---|---|
| 3,381,592 | 5/1968 | Ravel | 493/214 X |
| 3,839,128 | 10/1974 | Arai | 493/214 X |
| 3,986,914 | 10/1976 | Howard | 493/214 X |
| 4,807,300 | 2/1989 | Ausnit et al. | 493/214 X |
| 4,894,975 | 1/1990 | Ausnit | 53/412 |
| 4,971,454 | 11/1990 | Branson et al. | 493/214 X |
| 5,211,482 | 5/1993 | Tilman | 493/214 X |
| 5,425,216 | 6/1995 | Ausnit | 53/412 X |
| 5,558,613 | 9/1996 | Tilman et al. | 493/213 X |

*Primary Examiner*—Daniel B. Moon

*Attorney, Agent, or Firm*—Kane,Dalsimer,Sullivan, Kurucz, Levy, Eisele and Richard, LLP

[57] ABSTRACT

A reclosable package includes two sheets of a first polymeric resin material facing one another and forming a package opening having an inside and an outside. A first zipper strip having a male zipper profile and a first flange area, and a second zipper strip having a female zipper profile and a second flange area, are extruded from a second polymeric resin material. The first flange area is sealed to the first sheet with a first seal on the outside of the package opening, and the second flange area is sealed to the second sheet with a second seal on the outside of the package opening. The first and second seals are offset from one another relative to the male and female zipper profiles, so that the first and second seals are not in a back-to-back relationship with respect to one another.

4 Claims, 4 Drawing Sheets

OFFSET SEALING METHOD FOR PLASTIC FILMS

This application is a division of Ser. No. 08/804,627 filed on Feb. 25, 1997.

BACKGROUND OF THE INVENTION

1. Field of the Invention

The present invention relates to the packaging art, and, more specifically, relates to plastic bags or packages formed from extruded polymeric resin sheet material. In particular, the present invention relates to plastic bags or packages of this general type which have zipper closures extruded from polymeric resin material and attached thereto to form a reclosable plastic bag or package.

2. Description of the Prior Art

Plastic bags and packages having zipper enclosure extruded from a polymeric resin material, such as polyethylene, are old in the art. Commonly, bags and packages of this type are formed from plastic sheet material on a form-fill-and-seal (FFS) machine and concurrently filled with a consumer item or items. During the formation of the bags or packages, zipper closure strips are introduced between two facing internal portions of the plastic sheet material and sealed thereto.

Recently, the need to attach zipper closure strips to previously formed or manufactured plastic bags has arisen. The bags in question are formed from a tube of polyethylene. During manufacture, the tube is flattened, and sealed transversely at regularly spaced intervals. The seals ultimately become the bottoms of the bags. Adjacent to each seal, the flattened tube is perforated, so that the bags may be separated from one another. The perforations form the mouths or tops of the bags. The tube, perforated and sealed as described, is wound up in the form of a roll including as many as several thousand individual bags. Individual bags are fed, bottom first, from the roll by automatic bag filling equipment, which sequentially deposits a consumer item or items into each bag and seals each bag transversely below the perforations at the mouth or top thereof.

Where bags have previously been formed or manufactured, however, the zipper closure strip or strips must be attached to the outsides of the bags. Such attachment is carried out by some form of heat sealing. Unfortunately, because there is no way to keep the two layers of a previously formed bag separated from one another, there is a tendency for them to be sealed to one another during the attachment process.

The present invention provides a solution to this problem.

SUMMARY OF THE INVENTION

Accordingly, in its broadest form, the present invention is a reclosable package comprising a first sheet of a first polymeric resin material and a second sheet of a first polymeric resin material. The second sheet faces the first sheet and forms a package opening having an inside and an outside therewith.

The reclosable package also includes a first zipper strip and a second zipper strip. The first zipper strip has a male zipper profile and a first flange area, and is extruded from a second polymeric resin material. The second zipper strip has a female zipper profile and a second flange area, and is also extruded from the second polymeric resin material. The first and second zipper strips may conveniently be formed as parts of a common zipper tape.

The first flange area is attached to the first sheet with a first seal on the outside of the package opening. Concurrently, the second flange area is attached to the second sheet with a second seal on the outside of the package opening. The first and second seals are offset from one another relative to the male and female zipper profiles, which must be aligned with each other so that the first and second seals are not in a back-to-back relationship with respect to one another. The offset ensures that the inside of the package opening will not be sealed closed during the concurrent sealing process.

In a more specific embodiment, the reclosable package comprises a flattened tubular sheet of a first polymeric resin material. The flattened tubular sheet has a first side, a second side, first and second closed edges, and first and second open edges.

A zipper tape, extruded from a second polymeric resin material, includes a male zipper profile, a female zipper profile and, outward of the male and female zipper profiles, a first and second flange area. The zipper tape is folded, so that the male and female zipper profiles may interlock with one another, and the first and second flange areas may face one another. The first and second flange areas are sealed to the flattened tubular sheet adjacent to the first closed edge thereof. The first flange area is attached to the first side with a first seal, and the second flange areas is attached to the second side with a second seal. For the reasons given above, the first and second seals are offset from one another relative to the male and female zipper profiles, so that the first and second seals are not in a back-to-back relationship with respect to one another. To complete the manufacture of this reclosable package, the first and second open edges must ultimately be sealed.

The present invention also includes a method for manufacturing reclosable packages. The method includes the step of providing a flattened tubular sheet of a first polymeric resin material. The sheet is sealed transversely at regularly spaced intervals and perforated transversely at equally spaced intervals.

A zipper tape of the above-described type is provided and folded so that the male and female zipper profiles may interlock with one another, and said first and second flange areas may face one another.

The flattened tubular sheet is then directed longitudinally between the first and second flange areas, which are then concurrently sealed thereto with first and second seals. As before, the first and second seals are offset from one another with respect to the male and female zipper profiles, so that the flattened tubular sheet will not be sealed internally to itself.

The method also requires the zipper tape to be cut at the transverse perforations across the flattened tubular sheet, and a second transverse seal to be made to close the bag.

The present invention will now be described in more complete detail with frequent reference being made to the several drawing figures identified as follows:

DETAILED DESCRIPTION OF THE PREFERRED EMBODIMENTS

Figure 1:
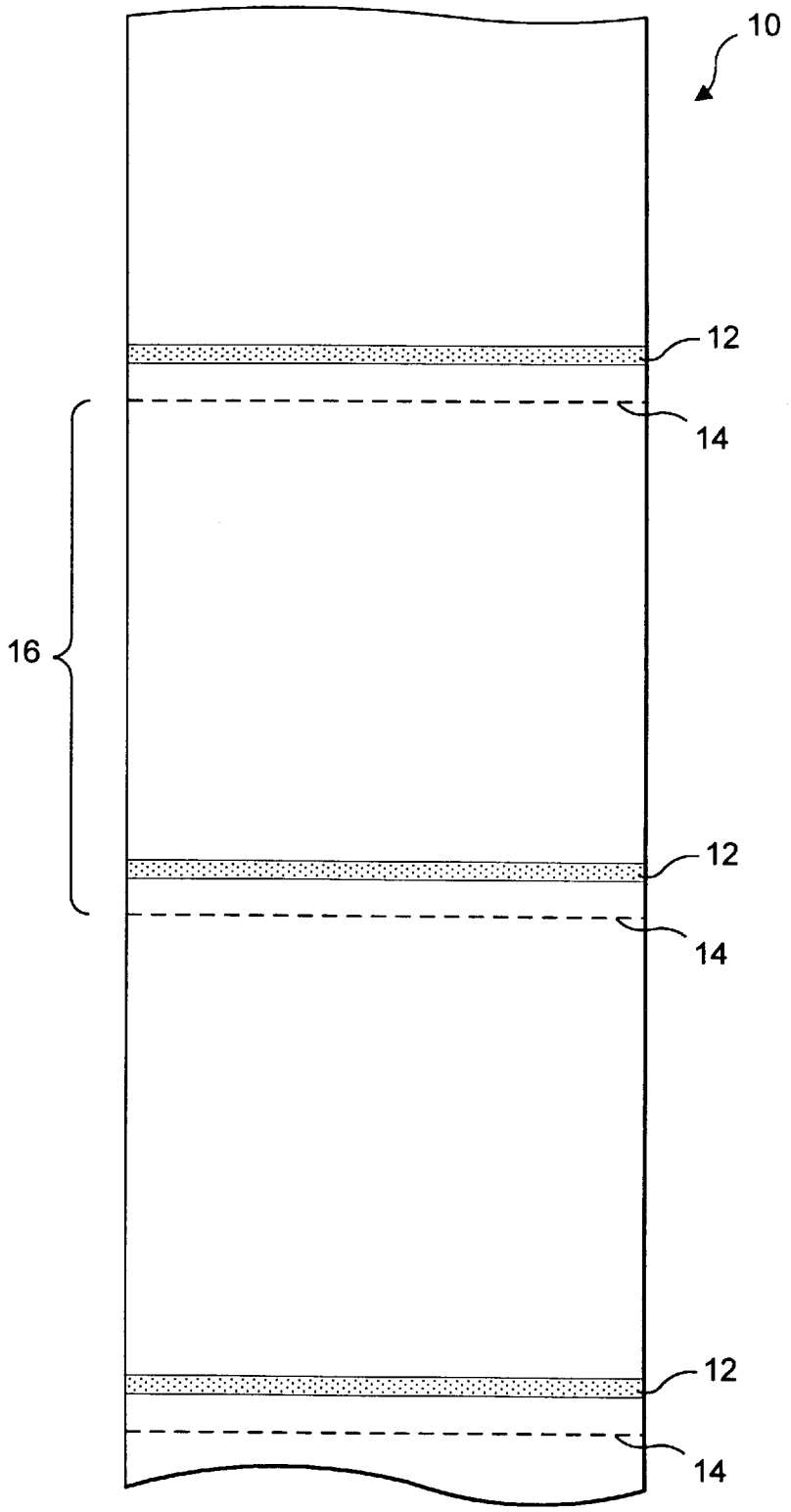
FIG. 1 is a plan view of a section of flattened low-density polyethylene tube sheet material.

Referring now to the several drawing figures, FIG. 1 is a plan view of a section of flattened low-density polyethylene (LDPE) tube sheet material 10. The sheet material 10 is sealed transversely at regular intervals with seals 12, and perforated at equally regular intervals with perforations 14 to form individual, connected bags 16. As stated earlier, the bags 16 may be provided on rolls having as many as several thousand bags 16, each connected to the next in the manner shown in FIG. 1.

As shown in FIG. 1, the seals 12 form the bottom of each successive bag 16, and the perforations 14 form their tops or mouths. Continuously connected bags 16 of this type are used in packaging equipment, wherein the bags 16 are fed, bottom first and at regular, bag-length intervals, past a hopper, which holds some commodity to be dispensed thereinto. In quick succession, the perforations 14 at the mouth of the bag 16 are opened next to the hopper, the commodity is dispensed into the bag, and the top of the bag is sealed in a manner similar to that used to seal the bottom. The filled bag 16 is then torn from the end of the flattened low-density polyethylene tube sheet material 10, and ultimately shipped to consumers.

There is a growing interest in providing this type of bag 16 with a reclosable zipper. Generally, interlocking zipper profiles are attached to the inner, mutually facing walls at the mouth of a bag. However, because bags 16 are previously manufactured, it is necessary in this instance to attach the zipper profiles to their outsides. The technical challenge to do so without sealing the bags closed by attaching the inner, mutually facing walls at the mouths of the bag 16 is met by the present invention.

Figure 2:
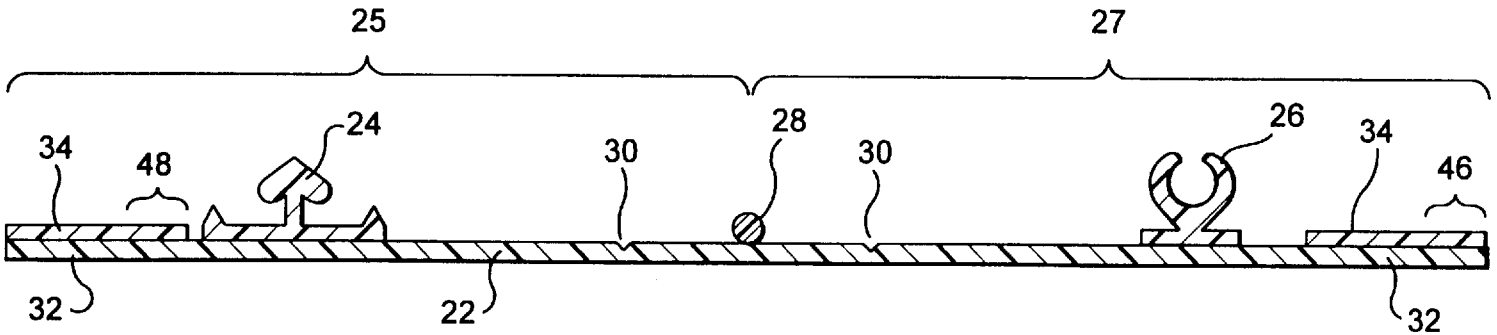
FIG. 2 is a cross-sectional view of a zipper tape with which the present invention may be practiced.

FIG. 2 is a cross-sectional view of a zipper tape 20 which may be used for this purpose. The zipper tape 20 comprises a base 22, and a male zipper profile 24, a female zipper profile 26, and a tear bead 28 extruded onto the base 22. The zipper tape 20 thus comprises what may be considered a male zipper strip 25 and a female zipper strip 27. Base 22, male and female zipper profiles 24, 26, and tear bead 28 are all extruded from a low-density polyethylene (LDPE). The tear bead 28 is extruded onto the center of the base 22, and male and female zipper profiles 24, 26 are extruded more or less equally spaced on either side of the tear bead 28. Alternatively, base 22, male and female zipper profiles 24, 26 and tear bead 28 may be coextruded with one another. Perforations 30 are provided longitudinally along the zipper tape 20 between the tear bead 28 and each of the male and female zipper profiles 24, 26 so that the bags or packages being manufactured may be opened by grasping and pulling the tear bead 28.

Outward of the male and female zipper profiles 24, 26 are flange areas 32 which are used to attach the zipper tape 20 to the low-density polyethylene sheet forming the bag. Optionally, a low-melting-point sealant layer 34 may be provided on each of the flange areas 32. A material marketed by Exxon under the product designation LD 761.36 may be used for this purpose.

Figure 3:
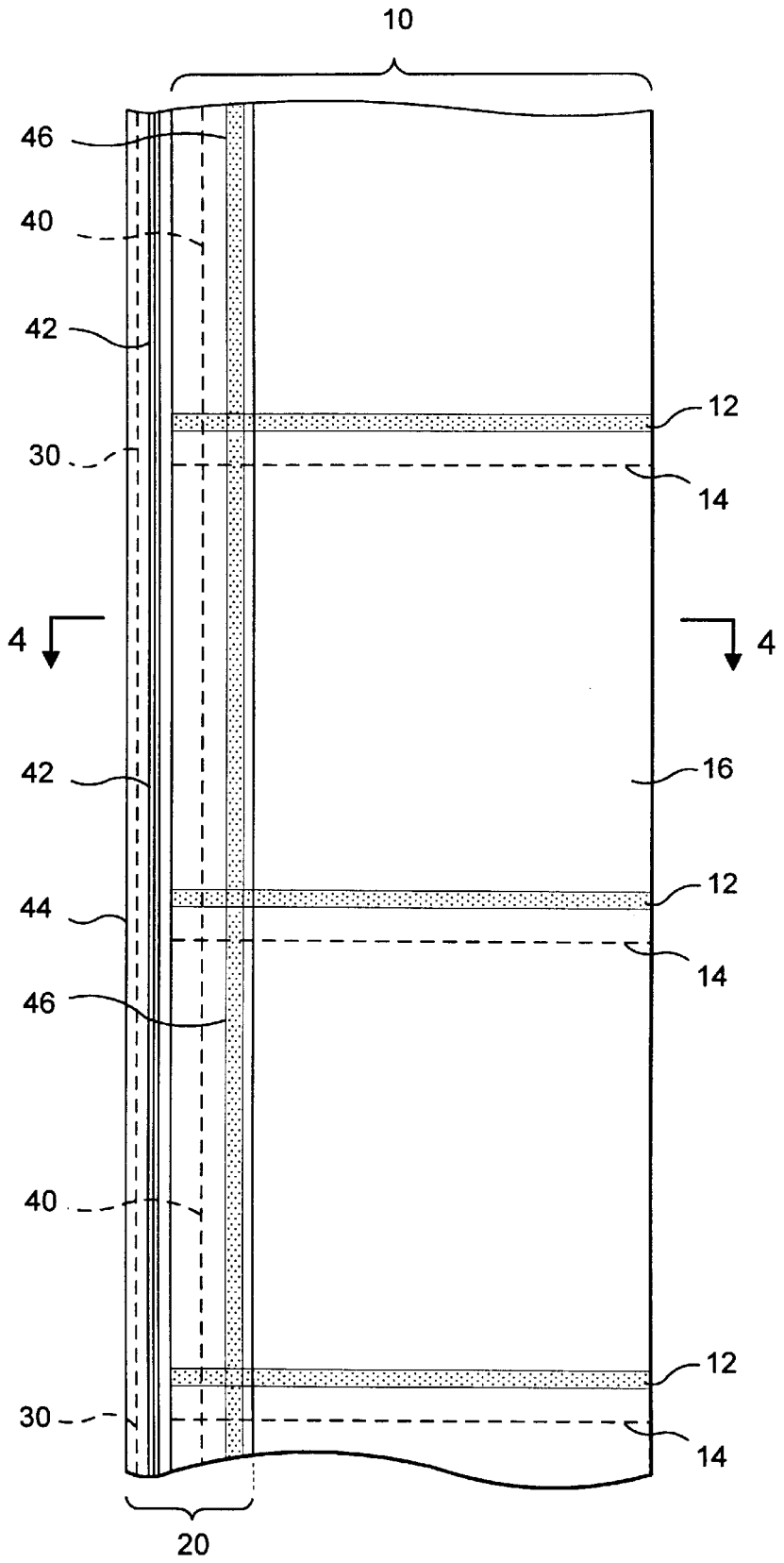
FIG. 3 is a plan view of the section of flattened low-density polyethylene tube sheet material with zipper tape attached thereto.

FIG. 3 is a plan view of the section of flattened low-density polyethylene tube sheet material shown in FIG. 1 with zipper tape 20 attached thereto. It will be noted that zipper tape 20 is attached longitudinally along the flattened low-density polyethylene tube sheet material 10, that is, along one of the two sides of the individual connected bags 16. Along that side, the sheet material 10 is perforated longitudinally with perforations 40, so that access to the interior of the bags 16 through what will eventually be their tops or mouths may be had.

The zipper tape 20 is shown in a folded configuration with male and female zipper profiles 24, 26 interlocked with one another as indicated in FIG. 3 by interlocked profiles 42. Perforations 30 are adjacent to the left-hand edge 44 of the zipper tape 20. Tear bead 28, not visible in FIG. 3, but disposed within the folded zipper tape 20 along its left-hand edge 44.

It will be noted that zipper tape 20 is attached to sheet material 10 by heat-sealing or similar methods. One seal 46 is visible in FIG. 3, the other being on the other side of the sheet material 10.

Figure 4:
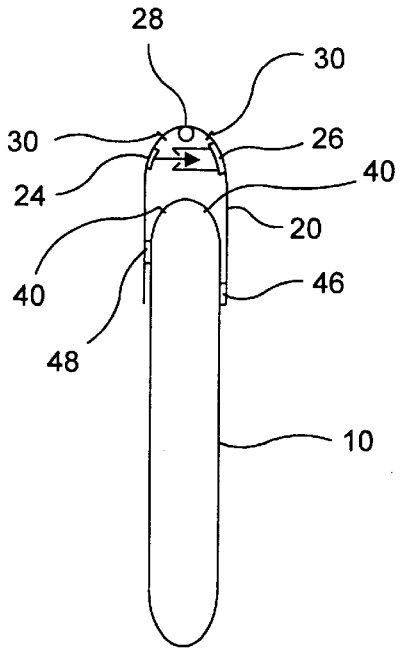
FIG. 4 is a cross-sectional view taken as indicated by line 4—4 in FIG. 3.

To illustrate the manner in which the zipper tape 20 is sealed to the sheet material 10, FIG. 4 is a simplified cross-sectional view taken as indicated by line 4—4 in FIG. 3. For the sake of clarity, it should be understood, elements in FIG. 4 have been depicted in an unflattened condition. In practice, sheet material 10 is in a flattened condition, while zipper tape 20 is folded and attached thereto as shown.

Since the sheet material 10 is in a flattened state, it is possible for the inside surfaces of the flattened sheet material 10 to be sealed to one another when the zipper tape 20 is attached to the outer surfaces. The present invention is a solution to this problem. It will be seen in FIG. 4 that seal 46 and seal 48 (not visible in FIG. 3) are offset from one another, rather than being disposed in a back-to-back relationship. To produce the offset seals 46, 48, paired heated and unheated sealing bars are used. This ensures that the inner surfaces of the sheet material 10 at the locations of the seals 46, 48 never reach the melting temperature of the low-density polyethylene material, and therefore do not become joined to one another. By way of contrast, where paired heated sealing bars are used to produce seals 46, 48 in a back-to-back relationship without separating the inner surfaces of the sheet material 10, the inner surfaces of the sheet material 10 at the locations of the seals 46, 48 can reach the melting temperature, enabling them to be sealed to one another. For clarity, the sealing areas 46 and 48 have been indicated on FIG. 2.

Figure 5:
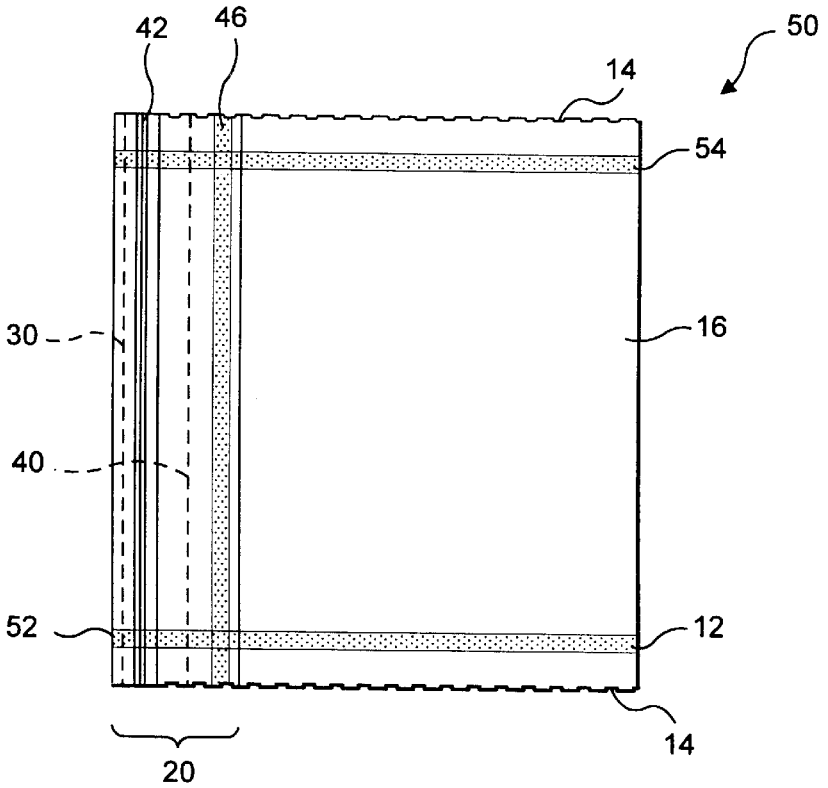
FIG. 5 is a plan view of a finished bag.

FIG. 5 is a plan view of a finished bag 50 separated from the flattened low-density polyethylene (LDPE) tube sheet material 10. At perforations 14, zipper tape 20 must be cut to separate one finished bag from the next. Zipper tape 20 must also be sealed with seal 52 in line with seal 12 to complete one side seal of the finished bag 50. Finally, seal 54 is made to form the other side seal of the finished bag 50. One grasping the tear bead 28 (left-hand edge 44) may separate the zipper tape 20 to separate the zipper strips 25 and 27 at perforations 30 to gain access to the interlocked profiles 42. In turn, interlocked profiles 42 may be separated and perforations 40 may be broken to gain access to the interior of bag 50.

Modifications to the above would be obvious to those of ordinary skill in the art, but would not bring the invention so modified beyond the scope of the appended claims.

What is claimed is:

1. A method for manufacturing reclosable packages comprising the steps of:

providing a flattened tubular sheet of a polymeric resin material, said sheet being sealed transversely at regularly spaced intervals and being perforated transversely at equally spaced intervals;

providing a zipper tape extruded from a polymeric resin material, said zipper tape having a male zipper profile, a female zipper profile and, outward of said male and female zipper profiles, a first and second flange area;

folding said zipper tape so that said male and female zipper profiles may interlock with one another and said first and second flange areas may face one another;

directing said flattened tubular sheet longitudinally between said first and second flange areas; and sealing said first and second flange areas to said flattened tubular sheet with a first and a second seal, respectively, said first and second seals being offset from one another with respect to said male and female zipper profiles, so that said flattened tubular sheet will not be sealed internally to itself.

2. A method as claimed in claim 1 further comprising the step of perforating said flattened tubular sheet longitudinally along an edge thereof.

3. A method as claimed in claim 1 further comprising the step of cutting said zipper tape where said flattened tubular sheet is transversely perforated.

4. A method as claimed in claim 1 further comprising the step of providing a second transverse seal across said flattened tubular sheet and said zipper tape.

* * * * *